United States Patent [19]

Simonds

[11] 4,353,499

[45] Oct. 12, 1982

[54] CENTRIFUGAL SEPARATOR

[76] Inventor: Edward Simonds, 1505 E. Kenosha, Broken Arrow, Okla. 74012

[21] Appl. No.: 257,732

[22] Filed: Apr. 27, 1981

[51] Int. Cl.[3] ..... B04B 1/04

[52] U.S. Cl. ..... 233/27; 233/17; 233/28; 233/32; 233/42

[58] Field of Search ..... 233/27, 28, 32, 33, 233/38, 40, 44, 17; 210/360.1, 369

[56] References Cited

U.S. PATENT DOCUMENTS 2,500,100 3/1950 Strezynski ..... 233/27

3,814,307 6/1974 Hengstebeck ..... 233/44

3,991,935 11/1976 Henning ..... 233/32

*Primary Examiner*—Robert W. Jenkins

*Attorney, Agent, or Firm*—Head, Johnson & Stevenson

[57] ABSTRACT

A centrifugal separator for a fluid stream and comprising a stationary outer housing having a drive drum assembly rotatably mounted therein, the drive drum assembly including multiple fluid compartments in successive downstream communication for successively receiving the fluid stream therein. The fluid stream is centrifuged in each of the fluid compartments whereby an efficiently separated fluid stream is discharged from the drive drum assembly for delivery to the ultimate use for the fluid stream.

7 Claims, 3 Drawing Figures

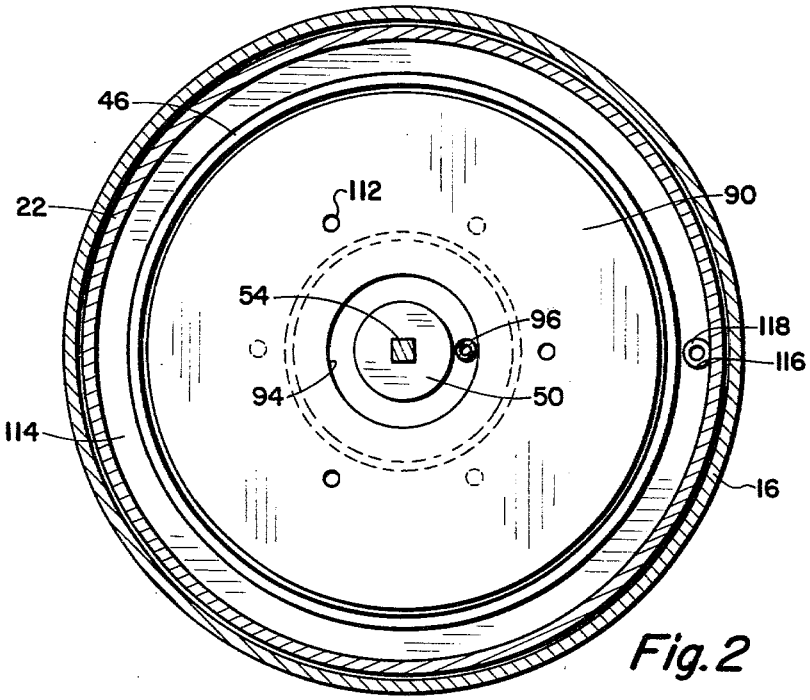
Fig. 2
Fig. 3
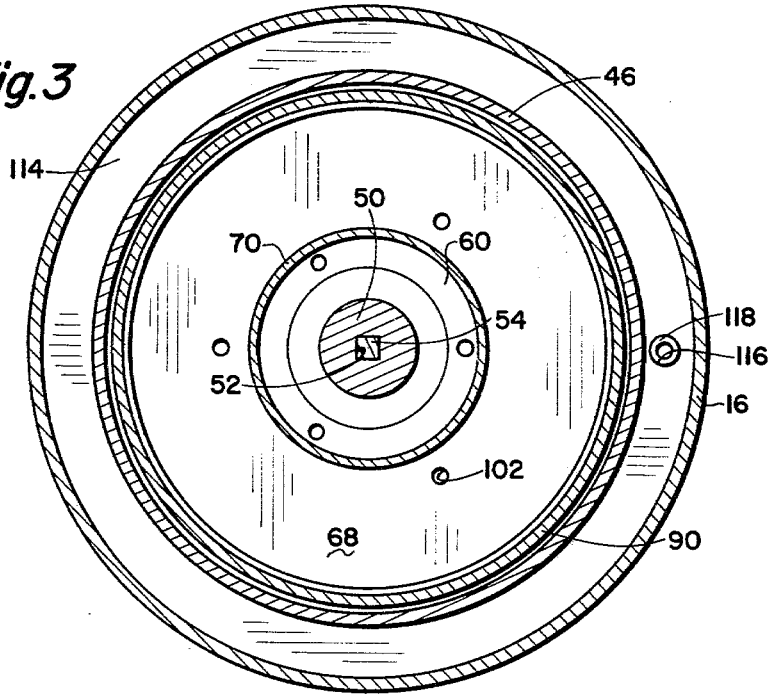

CENTRIFUGAL SEPARATOR

BACKGROUND OF THE INVENTION

1. Field of the Invention

This invention relates to improvements in fluid separators and more particularly, but not by way of limitation, to a centrifugal fluid separator.

2. Description of the Prior Art

It is frequently desirable to separate the components of a fluid stream for delivery of a substantially uncontaminated fluid for ultimate use, such as in the purification of water, the cleaning of oil used in a piston-type internal combustion engine, or the like. In the case of the oil of an internal combustion engine, it is the usual practice to pass the oil through an oil filter device wherein entrained particles or debris is filtered or separated from the oil in order that substantially clean oil is delivered to the engine pistons. These filters have certain disadvantages in that the filter elements frequently become clogged and hamper the delivery of the oil to the pistons, or may not provide an efficient cleaning of the oil. As a result the oil filter devices usually require frequent replacement since any interference with the purity or cleanliness of the oil moving to the pistons can cause serious damage to the engine, and the disadvantages of faulty filters will be readily apparent.

SUMMARY OF THE INVENTION

The present invention contemplates a novel centrifugal filter apparatus for efficiently separating undesirable components from a fluid stream, and whereas the particular utilization set forth herein is related to use of the device in connection with the pistons of an internal combustion engine, it will be apparent that the device is applicable for use in substantially any application wherein a fluid stream includes components desirable for mutual separation. The novel device comprises a housing having a rotatable centrifuge journalled therein and operably connected with a suitable power source, such as an electric motor, or the like. A removable cover means is provided for the housing, and fluid inlet means is carried by the cover means for directing the oil stream from the exterior of the housing to an inner chamber provided in the centrifuge in the proximity of the axis of rotation thereof. A plurality of successive fluid chambers are provided within the centrifuge, and the oil stream is initially directed from the central chamber to the lowermost fluid chamber by gravity. As the centrifuge rotates within the housing, the heavier components of the fluid stream are cast radially outwardly against the inner periphery of the outward wall of the centrifuge and when the lower most fluid chamber is sufficiently filled with the oil or fluid, the lighter components of the fluid stream will move upwardly into the next succeeding fluid chamber. The separation of the heavier components of the fluid stream from the lighter components thereof will be repeated in each successive fluid chamber, whereupon substantially clean fluid is discharged from the rotating centrifuge and deposited within the housing surrounding the outer periphery of the centrifuge. Discharge outlet means is provided in the housing for releasing the clean oil for passage to the engine pistons, or the like, in the usual manner. The novel apparatus efficiently cleans the fluid stream passing therethrough, or separates heavier components from lighter components of the fluid stream, discharging the lighter components and trapping the heavier components within the centrifuge element. Of course, it may be necessary to remove the cover means from the housing to provide access to the centrifuge element for cleaning the debris or removing the heavier fluid components therefrom, but the apparatus may be efficiently utilized for relatively long periods of time before such cleaning becomes necessary. The novel centrifugal separator apparatus is simple and efficient in operation and economical and durable in construction.

BRIEF DESCRIPTION OF THE DRAWINGS

FIG. 2 is a view taken on line 2—2 of FIG. 1.

FIG. 3 is a view taken on line 3—3 of FIG. 1.

DETAILED DESCRIPTION OF THE PREFERRED EMBODIMENT

Figure 1:
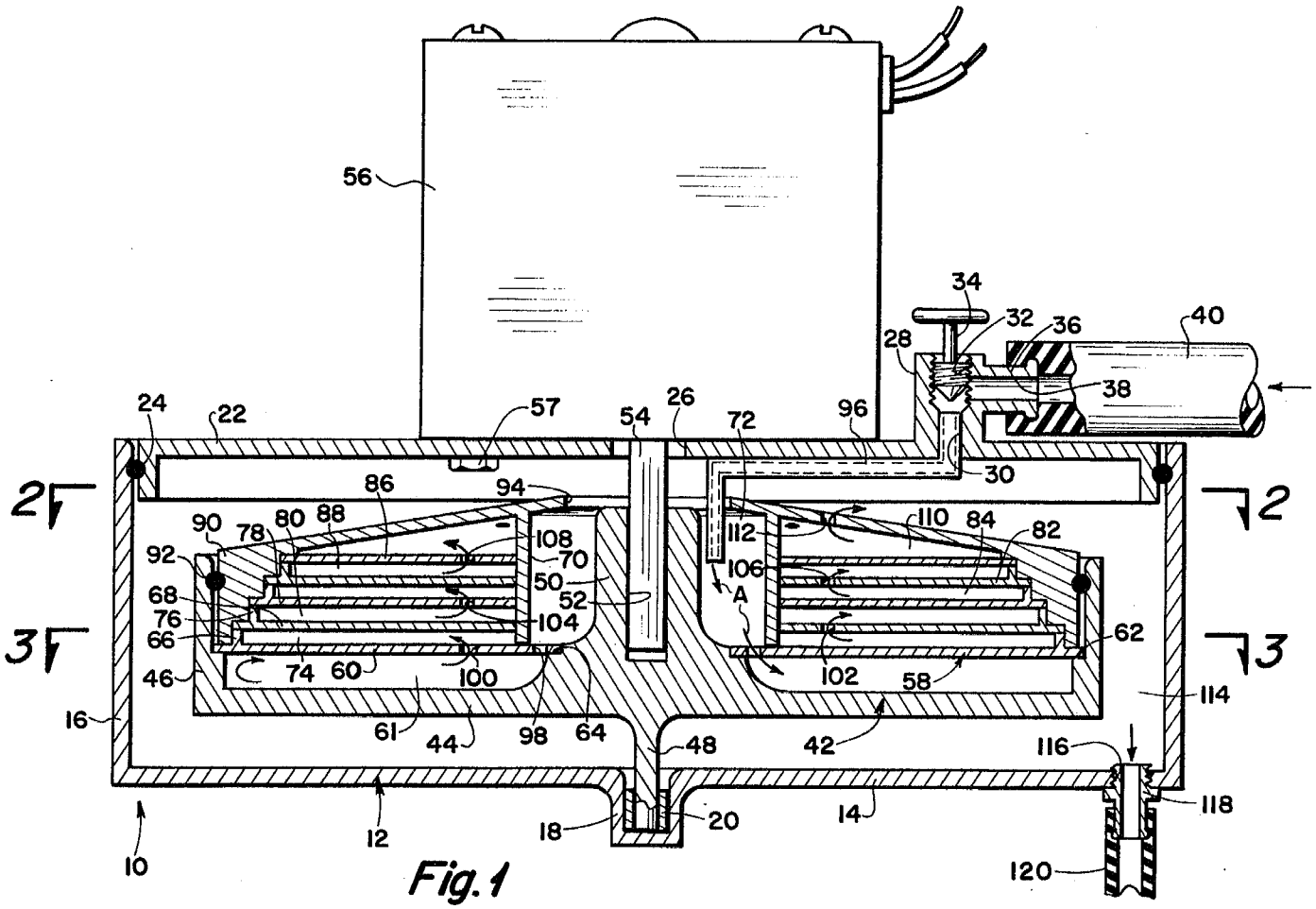
FIG. 1 is a sectional elevational view of a centrifugal separator embodying the invention, with portions shown in elevation for purposes of illustration.

Referring to the drawings in detail, reference character 10 generally indicates a centrifugal separator apparatus comprising an outer stationary housing 12 having a bottom plate 14 and upstanding walls 16 provided around the outer periphery thereof. A centrally disposed well or recess 18 is provided in the bottom plate 14 for receiving a suitable bushing member 20 therein. The outer end of the housing 12 is open and a suitable motor mounting plate means 22 is removably secured thereto. Suitable sealing means 24, such as an O-ring, or the like, is interposed between the plate 22 and peripheral walls 16 for removably securing the plate 22 to the housing 12 and precluding leakage of fluid therebetween. A centrally disposed aperture or bore 26 is provided in the plate means 22 for a purpose as will be hereinafter set forth. In addition, an upstanding boss 28 is provided for the plate means 22, and may be either integral therewith or secured thereto in any well known manner. A passageway 30 extends longitudinally through the boss 28 to provide a fluid inlet for the interior of the housing 12, and the passageway 30 is enlarged at 32 and internally threaded for receiving a suitable regulating valve member 34 therein. A sleeve member 36 extends radially outwardly from the boss 28 and is provided with an internal bore 38 extending into communication with the passageway 30 for cooperating therewith to provide a fluid inlet passage for the apparatus 10. One end of a suitable fluid line or conduit 40 is connected with the outer end of the sleeve 36 in any well known manner for directing a fluid stream to the fluid passageway 38 as will be hereinafter set forth.

A rotatable centrifuge or drive drum assembly 42 is disposed within the housing 12 for rotation about its own central axis independently with respect to the housing 12. The centrifuge 42 comprises a substantially circular bottom plate 44 having a wall or sleeve member 46 extending substantially perpendicularly therefrom around the outer periphery thereof. A centrally disposed axle member 48 extends axially outwardly from the bottom plate 44 for insertion in the bushing 20 for rotatably supporting the centrifuge 42 within the housing 12. In addition, a central hub means 50 extends axially inwardly from the bottom plate 44 and is provided with a central bore 52 for receiving the drive shaft 54 of a suitable power source, such as an electric motor 56, therein. The motor 56 may be mounted on or secured to the mounting plate 22 in any well known manner, such as mounting bolts 57. The cross-sectional configuration of the outer periphery of the drive shaft 54 may be of a complementary driving configuration with respect to the cross-sectional configuration of the bore 52, if desired, or the shaft 54 may be otherwise drivingly connected with the bore 52 whereby the housing 44 may be readily rotated about its own central or longitudinal axis upon activation of the motor 56, as is well known.

A multi-chamber separator assembly, generally indicated at 58, is disposed within the housing 44, and comprises a first annular disc or plate member 60 having the outer periphery thereof supported by an inwardly directed annular shoulder 62 provided on the inner periphery of the sleeve 46 and the inner periphery thereof supported by an outwardly directed annular shoulder 64 provided on the outer periphery of the hub means 50. The plate 60 is spaced from the bottom plate 44 to provide a fluid chamber 61 therebetween. An upstanding circular flange 66 is provided on the inner face of the plate 60 and is spaced slightly inboard of the other periphery thereof as particularly shown in FIG. 1 for supporting the outer periphery of a second annular disc 68 thereon. The inner periphery of the plate 68 tightly engages the outer periphery of a sleeve 70 which is concentrically arranged around the outer periphery of the hub means 50 and spaced therefrom to provide a central chamber 72 therebetween. The disc 68 is spaced from the disc 60 to provide a fluid chamber 74 therebetween. The outer diameter of the disc 68 is preferably slightly smaller than the outer diameter of the disc 60, and an upstanding circular flange 76 extends outwardly from the inner face thereof for supporting the outer periphery of a third annular disc or plate 78 thereon. The inner periphery of the plate 78 is in a tight engagement with the outer periphery of the sleeve 70, and the plate 78 is spaced from the plate 68 to provide a fluid chamber 80 therebetween. The outer diameter of the plate 78 is preferably smaller than the outer diameter of the plate 68, and still another annular disc 82 similar to the discs 68 and 78 is similarly supported in spaced relation above the disc 78 to provide still another fluid chamber 84 therebetween. Still another annular disc 86 similar to the discs 82, 78 and 68 is similarly supported in spaced relation with respect to the disc 82 to provide a fluid chamber 88 therebetween.

The sleeve 70 is either integral with or secured to the inner periphery of a disc cover means 90 having a substantially cylindrical outer periphery of a diameter slightly less than the inner diameter of the sleeve 46 for ready insertion therein. A suitable sealing member, such as an O-ring 92, is interposed between the outer periphery of the disc cover 90 and the inner periphery of the sleeve 46 for not only removably securing the disc cover in position but also precluding leakage of fluid therebetween. The inner periphery of the cylindrical portion of the disc cover 90 is of a stair-stepped cross-section configuration complementary to the configuration of the outer periphery of the stacked discs 68-78-82 and 86, and bears against the outer periphery of each disc for securely retaining the discs in the stacked position shown in FIG. 1. A central bore 94 is provided at the upper end of the disc cover 90 and is concentrically arranged with respect to the hub means 50 to provide communication between the chamber 72 and the exterior of the assembly 42. In addition, a suitable conduit means 96 extends from the passageway 30 into the chamber 72 for communication fluid from the line 40 into the chamber 72 for a purpose as will be hereinafter set forth.

The lowermost disc or plate 60 is provided with a plurality of circumferentially spaced bores 98 disposed in substantial alignment with the chamber 72 to provide communication between the chamber 72 and the chamber 61, and is further provided with a plurality of spaced ports 100 disposed outboard of the bores 98 to provide communication between the chamber 61 and the chamber 74. The disc 68 is provided with a plurality of circumferentially spaced ports 102 arranged in an offset relation with respect to the ports 100 to provide communication between the chambers 74 and 80. The disc 78 is similarly provided with a plurality of circumferentially spaced ports 104 offset with respect to the ports 102 for providing communication between the chambers 80 and 84. The disc 82 is provided with a plurality of circumferentially spaced ports 106 offset with respect to the ports 104 to provide communication between the chamber 84 and 88. The uppermost disc 86 is provided with a plurality of circumferentially spaced ports 108 offset with respect to the ports 106 for providing communication between the chamber 88 and an upper chamber 110 provided between the disc 86 and the inner periphery of the disc cover 90. In addition, the disc cover 90 is provided with a plurality of spaced ports 112 disposed outboard of the sleeve 70 to provide communication between the chamber 110 and the exterior of the assembly 42.

It will be readily apparent from an inspection of FIG. 1 that the entire assembly 42 is enclosed by the housing 12 and motor mounting plate 22 and a fluid chamber 114 completely surrounds the assembly 42. The port 112 opens to the chamber 114, and a discharge port 116 is provided in the bottom plate 14 for receiving a suitable nipple member 118 therein which connects a suitable fuel line 120 to the exhaust or discharge port 116 whereby oil may be delivered to the pistons (not shown) of an internal combustion engine (not shown) in the usual manner and for the usual purpose.

In use, the apparatus 10 may be installed at the desired site for utilization in any suitable manner whereby the housing 12 will be held stationary with respect to the lines 40 and 120. The supply of fluid, such as engine oil moving to the engine pistons, may be delivered into the chamber 72 through the passageways 38 and 30 and conduit 96. The regulating valve 34 may be adjusted in the usual manner for controlling the flow of the oil through the passageways and into the chamber 72. Upon activation of the motor 56, the assembly 42 will be rotated within the housing 12 and about its own central or longitudinal axis by virtue of the connection between the drive shaft 54 and bore 52. The motor 56 may be operably connected with any suitable source of energy, such as the electrical system associated with the internal combustion engine, as is well known.

The fluid in the chamber 72 falls by gravity into the chamber 61, and as the drum or assembly 42 rotates, the centrifugal forces acting on the fluid within the chamber 61 causes the heavier particles to move radially outwardly toward the inner periphery of the walls 16. The fluid is also whirled about within the chamber 61, and as the fluid level rises therein, the lighter components of the fluid stream will be forced upwardly through the ports 102 into the next succeeding chamber 74. The fluid in the chamber 74 receives the same treatment as the fluid in the chamber 61 and rises to the next succeeding chamber 84 through the ports 104, and as the fluid continues through the disc assembly 58, the substantially clean and particle free oil is discharged from the assembly 42 through the ports 112 of the disc cover means 90. Clean or separated oil is thus delivered into the chamber 114 and discharged therefrom through the exhaust port 116 for delivery to the piston of the engine.

When it becomes necessary to clean the interior of the apparatus 10, the motor 56 may be deactivated in the usual or well known manner and the mounting plate 22 may be removed by exerting sufficient manual pressure thereon to overcome the frictional engagement of the O-ring 24 with the walls 16, thus providing access to the interior of the housing. The assembly 42 may be removed from the housing 12, if desired, for facilitating access thereto, and the disc cover 90 may be removed by exerting sufficient manual force for overcoming the engagement between the sleeve 46 and cover 90. The discs may be removed from the stacked position therebetween, thus facilitating the cleaning of the entire interior of the assembly 42.

The discs may be replaced in the relative stacked positions thereof, and the cover 90 may be replaced whereupon the assembly 42 may be returned to the interior of the housing and the mounting plate 22 may be replaced on the housing 12, and the operation of the apparatus 10 may be resumed as hereinbefore set forth.

From the foregoing it will be apparent that the present invention provides a novel centrifugal separator comprising an outer stationary housing and an inner rotatable drum assembly. The drum assembly is provided with multiple fluid compartments for succeedingly receiving and centrifuging the fluid stream therein, with the progressive fluid treatment as the fluid passes through the fluid chambers resulting in an efficiently separated fluid stream.

Whereas the present invention has been described in particular relation to the drawings attached hereto, it should be understood that other and further modifications, apart from those shown or suggested herein may be made within the spirit and scope of this invention.

What is claimed is:

1. A centrifugal separator for a fluid stream and comprising stationary housing means, power means, drive drum assembly mens rotatably disposed within said housing means and operably connected with the power means for rotation thereby, inlet port means in communication with the interior of the drive drum assembly means for directing the fluid stream thereto, multiple fluid compartments provided in said drive drum assembly in successive downstream communication for successively receiving the fluid stream therein and centrifuging the fluid stream in each compartment during rotation of the drive drum assembly means, discharge port means provided in the drive drum assembly means in communication between the interior thereof and the interior of the housing means for delivery of separated fluid into the housing means, and discharge port means provided in the housing means for directing the separated fluid therefrom.

2. A centrifugal separator as set forth in claim 1 wherein the drive drum assembly means includes a rotatable housing having an upstanding peripheral wall, a disc assembly providing said multiple fluid compartments disposed in the rotatable housing, a disc cover means removably secured to the rotatable housing for securing the disc assembly therein, sleeve means provided on the disc cover means for providing a central fluid chamber therein for initially receiving the fluid stream, and means providing communication between the central fluid chamber and the multiple chambers for directing the fluid stream thereto during rotation of the drive drum assembly means.

3. A centrifugal separator as set forth in claim 2 wherein the disc assembly comprises a plurality of stacked apertured disc members interposed between the sleeve means and the peripheral wall providing successively smaller fluid chambers in the downstream direction.

4. A centrifugal separator as set forth in claim 3 wherein each disc member is provided with an upstanding flange means for supporting the next succeeding disc member in spaced relation with respect thereto.

5. A centrifugal separator as set forth in claim 2 and including sealing means interposed between the disc cover means and the rotatable housing for removably securing the disc cover means thereto and precluding leakage of fluid therebetween.

6. A centrifugal separator as set forth in claim 1 wherein the inlet port means comprises fluid passageway means provided on the stationary housing for initially receiving the fluid stream therein, conduit means interposed between the fluid passageway means and the interior of the drive drum assembly means for directing the fluid stream thereto, and regulating valve means interposed in the fluid passageway means for regulating the flow of the fluid stream therethrough.

7. A centrifugal separator as set forth in claim 1 and including mounting plate means removably secured to the stationary housing means for supporting the power means, and sealing means interposed between the mounting plate means and stationary housing means for removably securing the mounting plate means thereto and precluding leakage of fluid therebetween.

* * * * *